United States Patent [19]

Ishikawa et al.

[11] 4,254,705

[45] Mar. 10, 1981

[54] PRINTING MAGNET DRIVE DEVICE

[75] Inventors: Masami Ishikawa; Hirochika Okano; Shigenobu Katagiri; Mitsugu Asano; Toshiaki Fujieda, all of Katsuta, Japan

[73] Assignee: Hitachi Koki Company Limited, Tokyo, Japan

[21] Appl. No.: 108,550

[22] Filed: Dec. 31, 1979

Related U.S. Application Data

[63] Continuation of Ser. No. 891,193, Mar. 29, 1978, abandoned.

[30] Foreign Application Priority Data

Apr. 15, 1977 [JP] Japan ..... 52-43902

[51] Int. Cl.[3] ..... B41J 9/38; H01H 47/32; B41J 9/14

[52] U.S. Cl. ..... 101/93.29; 323/280; 361/187; 400/157.2

[58] Field of Search ..... 101/93, 93.29–93.34, 101/93.41, 93.44, 93.46; 400/157.1–157.3; 323/DIG. 1, 22 Z, 22 T, 66; 361/187, 152, 160; 307/297

[56] References Cited

U.S. PATENT DOCUMENTS

| | | | |
|---|---|---|---|
| 3,029,423 | 4/1962 | Koranye | 361/187 X |
| 3,139,562 | 6/1964 | Freeborn | 361/187 |
| 3,549,955 | 12/1970 | Paine | 361/187 X |
| 3,577,062 | 5/1971 | Hoffman | 323/22 Z X |
| 3,589,282 | 6/1971 | King | 361/187 X |
| 3,624,492 | 5/1971 | Nielsen | 323/22 Z X |
| 3,628,102 | 12/1971 | Jaugh | 361/187 X |
| 3,633,496 | 1/1972 | Kearns | 101/93.34 |
| 3,634,751 | 1/1972 | Miller | 323/22 Z |
| 3,675,159 | 7/1972 | Judd et al. | 323/DIG. 1 |
| 3,728,688 | 4/1973 | Elmhurst | 101/93.29 X |
| 3,774,235 | 11/1973 | Kosco | 361/187 X |
| 3,786,314 | 1/1974 | Misch | 361/187 X |
| 3,826,969 | 7/1974 | Eichelberger et al. | 323/22 Z |
| 3,829,717 | 8/1974 | Harrison | 323/22 Z X |
| 3,881,150 | 4/1975 | Gay | 323/22 Z X |
| 3,882,372 | 5/1975 | Martynow et al. | 323/22 Z X |
| 3,918,043 | 11/1975 | Beck | 361/187 X |
| 4,008,418 | 2/1977 | Murphy | 323/22 Z |
| 4,019,100 | 4/1977 | Barrus | 101/93.29 |
| 4,083,299 | 4/1978 | Norton | 400/157.2 |
| 4,100,595 | 7/1978 | Pollmeier | 323/DIG. 1 |

FOREIGN PATENT DOCUMENTS

| | | | |
|---|---|---|---|
| 2012625 | 9/1971 | Fed. Rep. of Germany | 363/22 Z |
| 2247827 | 4/1973 | Fed. Rep. of Germany | 361/187 |
| 2325657 | 5/1973 | Fed. Rep. of Germany | 323/22 Z |
| 2403265 | 1/1974 | Fed. Rep. of Germany | 323/22 Z |
| 920162 | 3/1963 | United Kingdom | 361/187 |
| 1484789 | 9/1975 | United Kingdom | 323/22 Z |

OTHER PUBLICATIONS

"Electromagnet Control Circuitry", Beavers, IBM Tech. Discl. Bulletin, vol. 20, No. 3, 8/77, pp. 979–980.

"Switching Regulator", Pavek, IBM Tech. Discl. Bulletin, vol. 16, No. 12, 5/74, pp. 3911–3912.

"Voltage-Dip Sensor", Shelton, Jr., IBM Tech. Discl. Bulletin, vol. 19, No. 5, 10/76, pp. 1777–1778.

"Current Regulated Reference Diode", Ellis, Jr., IBM Tech. Discl. Bulletin, vol. 15, No. 8, 1/73, p. 2478.

"Voltage Comparator with Adjustable Trip Point & Hystersis", Beistle, IBM Tech. Discl. Bulletin, vol. 18, No. 11, 4/76, p. 3574.

"The Zener Diode", Mangieri, Popular Electronics, 7/73, pp. 40–44.

"On Chip Heater Helps to Stabilize Monolithic Reference Zener Diode", Dobkin, Electronics, 9/16/76, pp. 106–112.

"OP Amp Stabilizes Zener Diode in Reference-Voltage Source", Miller, Electronics, 2-20-75, pp. 101–105.

*Primary Examiner*—E. H. Eickholt

*Attorney, Agent, or Firm*—Fulwider, Patton, Rieber, Lee & Utecht

[57] ABSTRACT

An improved printing magnet drive device for use in a printing apparatus, such as line printer, is disclosed. The improvement comprises a constant voltage control means in which an output terminal voltage of a transistor is compared with a reference voltage and the comparison result is fed back to the transistor so as to control the output terminal voltage of the transistor to a predetermined value, whereby the voltage applied to the printing magnets is substantially maintained unchanged.

5 Claims, 2 Drawing Figures

PRINTING MAGNET DRIVE DEVICE

This is a continuation of application Ser. No. 891,193, filed Mar. 29, 1978 now abandoned.

BACKGROUND OF THE INVENTION

This invention relates to a driving device for printing magnets employed in printing apparatus such as line printers.

In some of such printing magnet drive devices, in order to reduce the number of drive circuits, the printing magnets are divided into a plurality of groups, and the magnets in each group are driven by one drive circuit. Hereinafter, a description will be made with reference to a case where the printing magnets are divided into two groups, that is, a group for odd columns, and a group for even columns, for convenience in description.

Shown in FIG. 1 is one example of a printing magnet drive device in which the printing magnets are divided into a group for odd columns and a group for even columns, and the printing magnets in each group are driven by one drive circuit.

Printing magnets 1 and 2 provided respectively for the odd columns and even columns and adapted to energize printing hammers (not shown) are connected to the terminals of a power source (not shown) through control transistors 3 and 4 reverse-current preventing diodes 5 and switching transistors 6. Furthermore, a series circuit of a diode 7 and a zener diode 8 which form a flyback absorption circuit is connected in parallel to each of the printing magnets 1 and 2. The aforementioned control transistors 3 and 4 are alternately rendered conductive by means of a shuttle switching control circuit 9 with the aid of an inverter 10. In other words, in the odd column printing, the transistor 3 is rendered conductive, while in the even column printing the transistor 4 is rendered conductive.

In the circuit thus organized, the saturation voltages across the collectors and emitters of the control transistors 3 and 4 are varied with the variations of currents flowing therebetween, and therefore the voltages applied to the printing magnets 1 and 2 cannot be maintained unchanged. This is one of the drawbacks accompanying the conventional printing magnet drive device. In other words, when the number of printing magnets 1 and 2 to be driven is changed, the saturation voltages of the transistors 3 and 4 are changed. When the voltages applied to the printing magnets 1 and 2 are changed, the flight time of the printing hammer, that is, the time interval which elapses from the beginning of energization till the hammer strikes a printing type is changed, as a result of which printing quality is lowered.

Furthermore, the number of zener diodes 8 forming flyback absorption circuits connected across the printing magnets 1 and 2 is relatively large, and therefore the conventional printing magnet drive device has problems to be solved with respect to the number of components and in manufacturing cost.

SUMMARY OF THE INVENTION

Accordingly, an object of the invention is to eliminate the variation in flight time and the lowering in printing quality by providing a constant voltage control means in which an output terminal voltage of a control transistor is compared with a reference voltage and the comparison result is fed back to the transistor so as to control the output terminal voltage of the control transistor to a predetermined value.

DETAILED DESCRIPTION OF A PREFERRED EMBODIMENT

Figure 1:
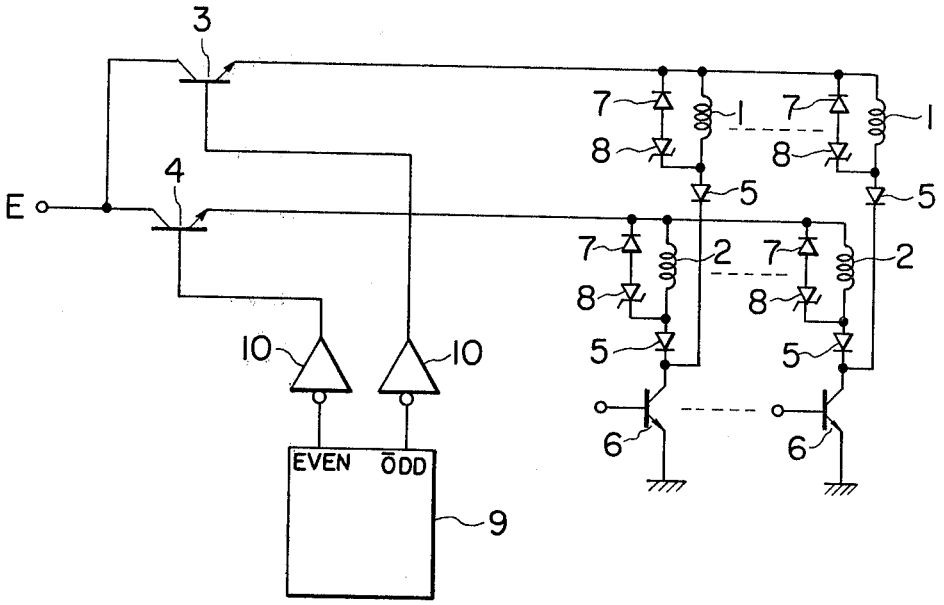
FIG. 1 PRIOR ART
FIG. 1 shows a circuit diagram of a conventional printing magnet drive device.
Figure 2:
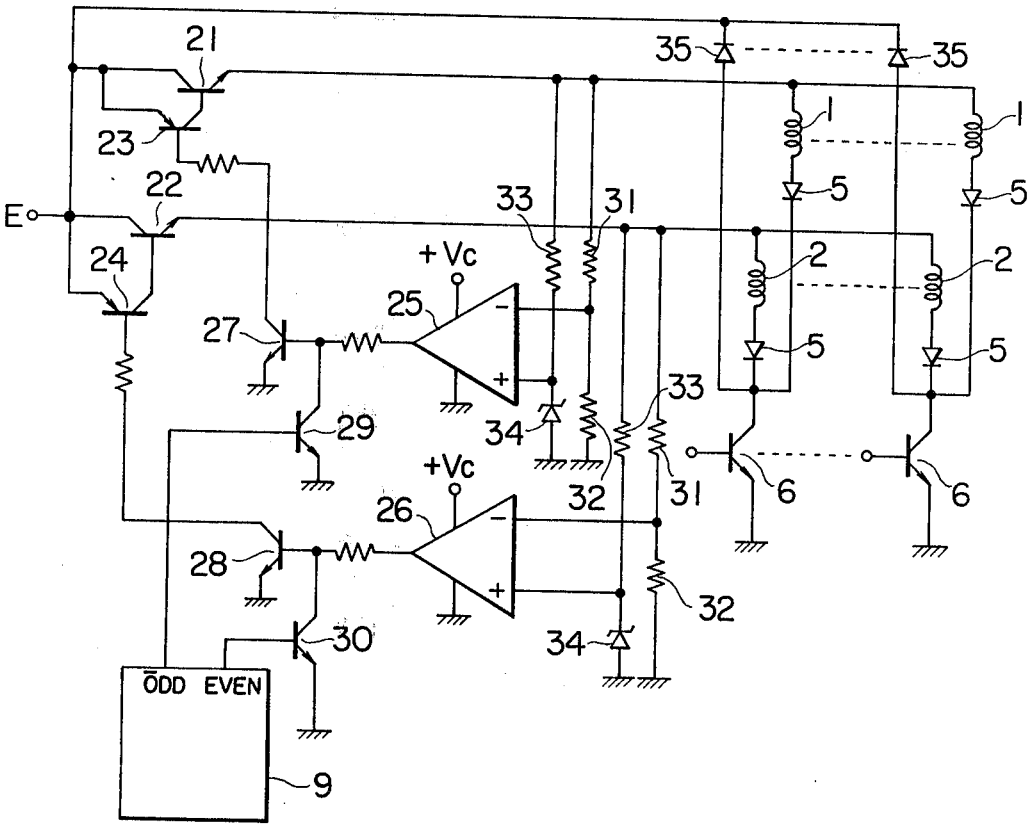
FIG. 2 shows a circuit diagram of a printing magnet drive device according to one embodiment of this invention.

One embodiment of this invention is shown in FIG. 2, in which those components which have been previously described with reference to FIG. 1 have therefore been similarly numbered. First terminals of the above-described printing magnets 1 and 2 are connected respectively through control transistors 21 and 22 to the power source. The emitters and collectors of auxiliary transistors 23 and 24 are connected between the collectors and bases of the transistors 21 and 22, respectively. The collector-emitter voltages of the transistors 21 and 22 are controlled so as to have predetermined values with the aid of transistors 27 and 28 by error amplifiers 25 and 26 adapted to amplify the difference voltages between the emitter voltages and the reference voltage, respectively; that is, the emitter voltages of the transistors 21 and 22 are controlled to predetermined voltages. Clamp transistors 29 and 30 are provided at the output sides of the amplifiers 25 and 26, so as to clamp the base voltages of the transistors 27 and 28 to predetermined values, respectively. In other words, in the odd column printing, the clamp transistor 30 is rendered conductive by a shuttle switching control circuit 9, and the base of the transistor 28 has a voltage substantially equal to the ground potential. As a result, the transistors 28, 24 and 22 are rendered non-conductive, and only the odd column printing magnet 1 is enabled. On the other hand, in the even column printing, the clamp transistor 29 is rendered conductive, and the base of the transistor 27 has a voltage substantially equal to the ground potential. As a result, the transistors 27, 23, and 21 are rendered non-conductive, and only the even column printing magnet 2 is enabled. The emitter voltages of the transistors 21 and 22 are detected by voltage division resistors 31 and 32, while the reference voltages are obtained by the combination of a resistor 33 and a zener diode 34. The flyback voltages of the printing magnets 1 and 2 mentioned above are fed back to the collectors of the control transistors 21 and 22 through diodes 35 and are clamped to the collector-emitter voltages of the transistors 21 and 22. In other words, since the control transistors 21 and 22 are used in the linear regions thereof during operation, the emitter-collector voltages are high, and therefore the transistors 21 and 22 carry out the clamping operation completely similarly as in the constant voltage diodes shown in FIG. 1. As a result, it is unnecessary to provide the zener diode 8 for each of the printing magnets 1 and 2. Accordingly, the construction of the printing magnet drive device can be simplified, and accordingly the manufacturing cost thereof can be reduced.

As is apparent from the above description, according to this invention, the voltages applied to the printing magnets can be controlled to predetermined values independently of the number of printing magnets, and therefore the drawback accompanying the conventional printing magnet drive device that print quality is lowered by the change in flight time of the printing hammer can be prevented. Furthermore, as the voltages are controlled to predetermined voltages by utilizing the transistors adapted to switch the divided printing magnet groups, the construction of the printing magnet drive device can be simplified.

What is claimed is:

1. In a printing magnet drive device for use in a printing apparatus wherein a plurality of printing magnets adapted to energize printing hammers juxtaposed along a printing line are divided into at least two groups, the printing magnets in each of the divided groups being connected in parallel through control transistor means to a power source and a switching element is connected to each of the printing magnets for controlling the energization of the associated printing magnet, the improvement comprising: means for controlling the output terminal voltage of said control transistor means, said means for controlling comprising reference voltage producing means for producing a reference voltage, comparison means for comparing the output terminal voltage of said control transistor means with the reference voltage and feed back means for feeding back the comparison result to said control transistor means, whereby the voltage applied to the printing magnets is substantially maintained constant.

2. A printing magnet drive device as claimed in claim 1 further comprising switching control means for selectively rendering said control transistor means conductive in a predetermined order.

3. A printing drive device as claimed in claim 2 wherein said plurality of printing magnets are divided into two groups, one of which being adapted to energize the printing hammers in even columns and the other of which being adapted to energize the printing hammers in odd columns, and wherein said comparison means includes an error amplifier adapted to amplify a difference voltage between the output terminal voltage of said control transistor means and the reference voltage, and wherein said switching control means includes a shuttle switching control circuit, a first switching element coupled to the output of said error amplifier and to said shuttle switching control circuit, and a second switching element coupled to said first switching element and to said control transistor means.

4. A printing magnet drive device as claimed in claim 1, 3 or 2 wherein a diode is interposed between the connection point of the printing magnet and the switching element and the control transistor means associated with said printing magnet for feeding back a flyback voltage of said printing magnet to said control transistor means.

5. A printing magnet drive device as claimed in claim 3 wherein the reference voltage is obtained by a combination of a resistor and a zener diode.

* * * * *